United States Patent [19]

Sable et al.

[11] 4,249,831

[45] Feb. 10, 1981

[54] WELL TOOL

[76] Inventors: Donald E. Sable, 4413 Windsor Pkwy., Dallas, Tex. 75205; Donald E. Sable, II, Box 1778, Mills, Wyo. 82644

[21] Appl. No.: 60,294

[22] Filed: Jul. 25, 1979

[51] Int. Cl.[3] ..... F16B 7/18

[52] U.S. Cl. ..... 403/12; 403/19; 403/343

[58] Field of Search ..... 403/343, 307, 19, 11, 403/360, 12

[56] References Cited

U.S. PATENT DOCUMENTS

| | | | |
|---|---|---|---|
| 705,443 | 7/1902 | Rallston | 403/19 |
| 3,201,158 | 8/1965 | Meripol | 403/307 |
| 3,489,445 | 1/1970 | Kammerer, Jr. | 403/343 |
| 4,076,436 | 2/1978 | Slator et al. | 403/343 |
| 4,084,829 | 4/1978 | Falchle | 403/343 X |

*Primary Examiner*—Andrew V. Kundrat

[57] ABSTRACT

A sinker bar connectable to other sinker bars, sucker rods and the reciprocable operator of a down hole pump by use of conventional elevator and hoist connectors without the use of auxiliary devices such as pony sucker rods, the sinker bar having a reduced intermediate portion below the top portion thereof engageable by a conventional elevator connector and an external annular groove in the top portion constituting means engageable by a conventional hoist connector.

1 Claim, 6 Drawing Figures

WELL TOOL

This invention relates to well tools and more particularly to sinker bars connectible between the bottom end of a sucker rod string and the reciprocable operator member of a down hole pump.

Well fluids of some wells are moved from producing earth formations to the surface through well flow conductors, e.g., a string of tubing, by a pump connected to the bottom end of the tubing having a reciprocable operator member driven reciprocally by a suitable sucker rod string which extends through the tubing from the pump operator member to the surface to a suitable drive means.

Due to the high hydraulic pressures at the bottom of the tubing due in part to the producing formation pressure and the density of the well fluids, the lowermost portion of the sucker rod string is subjected to upwardly acting forces which exceed the downwardly acting force. As a result, the lower portion of the sucker rod string is being forced upwardly and is under compression. This tends to cause bending and buckling of the sucker rod string and induce vibration in the sucker rod string and therefore in the pump mechanism.

The sucker rods are, of course, designed to be of smallest practical weight per unit of length and to offer the least impedance to flow of well fluids therepast through the tubing.

It has been the practice, as is pointed out in the Canadian Patent Ser. No. 954,038, issued Sept. 3, 1974, to Michael L. Rizzore and Walter S. Secrist, to add weight to the bottom portion of the sucker rod string to lower the level at which there is neither tension nor compression in the string. The type of "inertia" bar illustrated and described in this Canadian patent, however, cannot be disconnected from the next uppermost bar of the sucker bar string and moved to the usual rack or moved from the rack and connected to the uppermost bar without the use of a so-called pony sucker rod and a coupling for connecting the pony rod to the top end of uppermost sucker bar.

The "inertia" bar described is raised or lowered by an elevator device having a connector for engaging a reduced portion of the inertia bar and is moved laterally by a hoist having a connector which is releasable connectable to the top end of a pony sucker rod, which must be connected to the top end of the inertia bar by the usual internally threaded coupling.

It is desirable therefore that new and improved sinker bars be provided which are of such structure they may be moved into axial alignment and connected to one another or disconnected from one another with the disconnected bar being freed to be moved to the rack without the use of a pony sucker rod or any other tool which must be threaded to the top end of the sucker bar.

It is also desirable that such sinker bars be capable of being formed from bar stock by lathe operations only for economy of fabrication.

Accordingly, it is an object of this invention to provide a new and improved sinker bar.

Another object is to provide a new and improved sinker bar which may be formed by use solely of a lathe.

Still another object is to provide a sinker bar having reduced threaded pin portions on its ends, a reduced intermediate portion adjacent its top end engageable by an elevator connector and a portion between the top threaded pin portion and the reduced intermediate portion which is connectable to a hoist connector.

Another object is to provide a sinker bar having an elongate body provided with reduced threaded pin portions at its opposite ends, a reduced intermediate portion spaced a short distance from the top end of the body and a substantial distance from the bottom end, and an external annular groove between the top end of the intermediate portion and the top pin portion.

Still another object is to provide a sinker bar, of the type described, wherein the external annular groove permits connection of a hoist connector to the top end portion of the sinker bar and provides a downwardly facing annular shoulder engageable by the hoist connector whereby the sinker bar is supported by the hoist connector.

Additional objects and advantages of the sinker bar embodying the invention will become apparent upon the reading of the specification taken in connection with the accompanying drawings wherein FIG. 1 is a vertical partly sectional view of a well showing a sucker rod string employing the sinker bars embodying the invention;

Figure 1:
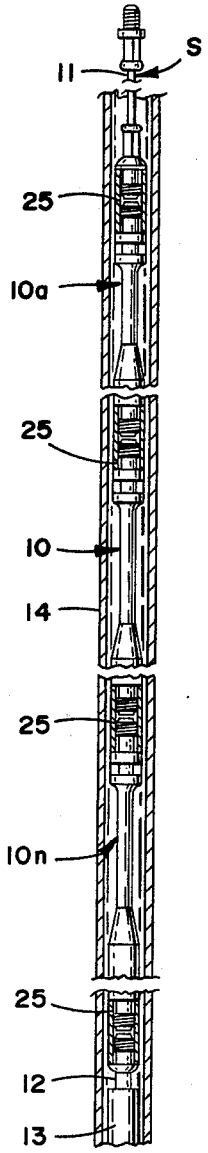

Referring now to FIG. 1 of the drawing, the sinker bars 10*a*–10*n* embodying the invention are shown connected to and between the lowermost sucker rod 11 of a sucker rod string S and the reciprocally movable operator or piston rod 12 of a subsurface pump 13 positioned in a well tubing 14.

The top end of the sucker rod string is connected at the surface to any suitable motor means for reciprocally moving the string S and, therefore the pump operator, to cause the pump to move well fluids upwardly to the surface from a producing earth formation through the well tubing 14.

Figure 2:
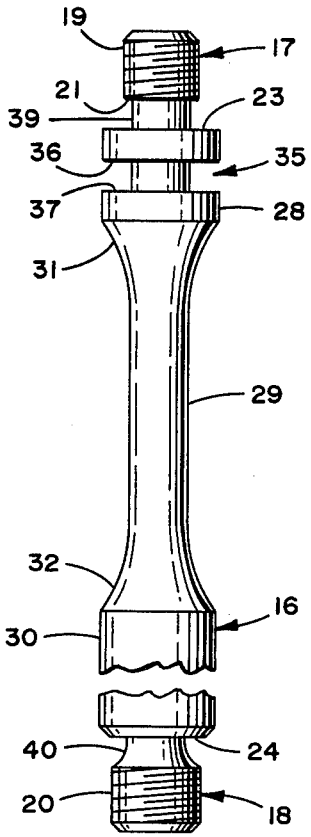
FIG. 2 is a vertical enlarged view of a sinker bar embodying the invention.

Each of the sinker bars 10 (FIG. 2) includes an elongate body 16, which is of considerable length, for example, 25 feet, provided at its opposite ends with top and bottom pins 17 and 18, respectively, which have enlarged outer threaded portions 19 and 20, respectively. The annular downwardly facing shoulder 21 on the bottom end of the top pin enlarged portion may be engaged by a suitable fishing tool in the event of some malfunction which requires retrieval of the sinker bar from the well tubing by a fishing tool. The oppositely facing annular end shoulders 23 and 24 of the body 16 act as stops for the internally threaded couplings or boxes 25 which connect adjacent ends of adjacent sinker bars to one another, the top end of the topmost sinker bar 10*a* to the bottom end of the lowermost sucker rod and the bottom end of the lowermost sinker bar 10*n* to the operator 12 of the pump 13.

Each of the sinker bars has a relatively short top portion 28, a reduced portion 29 and a bottom portion 30. A downwardly facing, upwardly and outwardly extending shoulder 31 and an upwardly facing, downwardly and outwardly extending surface or shoulder 32 extend from the top and bottom ends of the reduced body portion 29 to the top and bottom portions 28 and 30, respectively.

Figure 3:
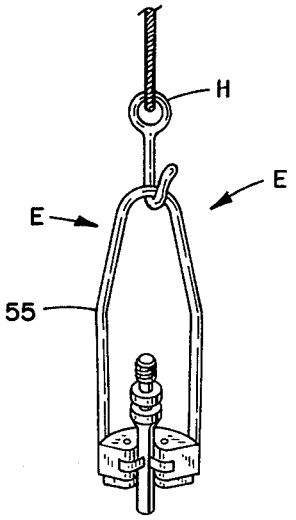
FIG. 3 is a perspective view of an elevator connector.
Figure 4:
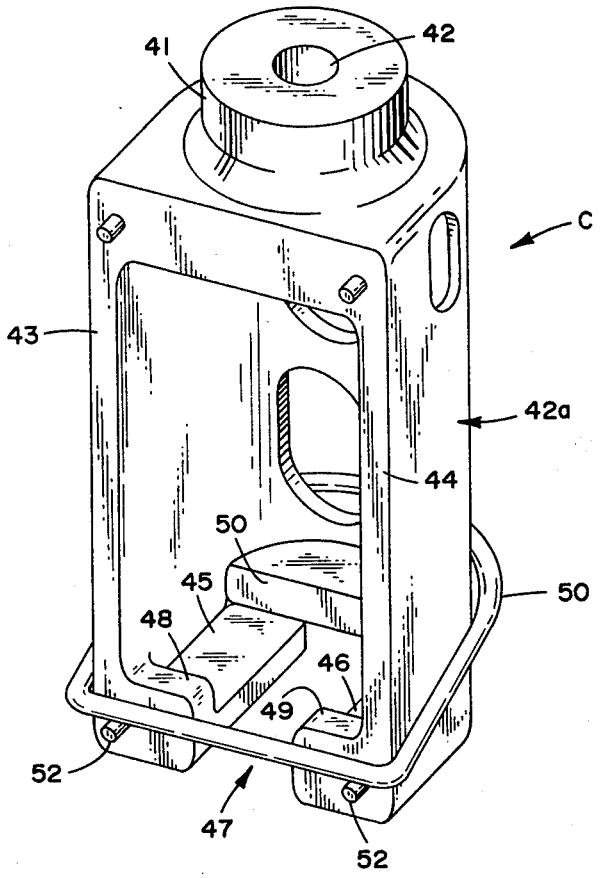
FIG. 4 is a perspective view of a hoist connector.
Figure 5:
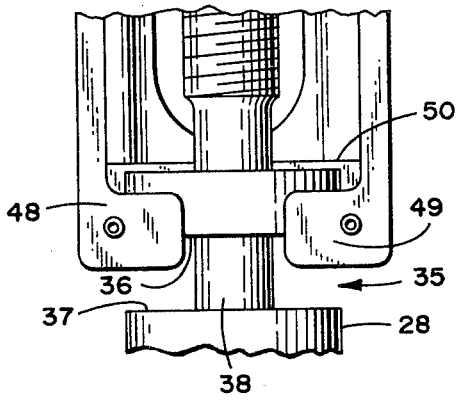
FIG. 5 is a fragmentary front view showing the hoist connector connected to a sinker bar.

The top and bottom portions 28 and 30 of the sinker body 16 may be of the same diameter as the couplings 25 while the reduced portion 29 is adapted to be engaged by a conventional sucker rod elevator E (FIG. 3). The downwardly facing shoulder 31 may also be engaged by such elevator to limit upward movement of the elevator relative to the sinker bar.

The top portion 28 of each sinker bar 10 is provided intermediate its top and bottom ends with an external annular groove 35 defined by the annular top and bottom surfaces 36 and 37.

The reduced portion 38 which defines the inner end of the groove is preferably at least equal in diameter to the smallest portions 39 and 40 of the pins 19 and 20, respectively, which constitute the portions of the sinker bar of lowest mechanical tensile strength.

The sinker bars are of integral construction and are fabricated from bar stock of the same or somewhat greater diameter as the top and bottom portions 28 and 30 of the sink bars.

It will be apparent to those skilled in the art that all forming operations required to convert a bar rod of uniform diameter into a sinker bar of the invention may be performed on the bar stock by simple lathe operations without requiring removal of the bar stock from the lathe until the sinker bar is completely fabricated.

The particular form and dimensions of the sinker bars embodying the invention have been chosen to provide the greatest weight per unit length of the sinker bars while permitting optimum flow of well fluids upwardly in the tubing past the sinker bars and permitting assembly and disassembly of the complete well tool which includes the sucker rod string S and the sinker bars using the usual and conventional elevator of the surface well equipment, which includes an elevator adapted to move such well tools vertically and in alignment with the central longitudinal axis of the well while supporting the full weight of the whole sucker rod string and sinker bars, and the usual and conventional hoist which may raise a single or several sucker rods and move them laterally from or to axial alignment with the well tubing and to or from the usual support rack which is laterally spaced from the vertical axis of the well tubing.

Such hoist employs a connector C whose top end portion 41 is provided with a central aperture 42 by means of which a suitable swivel means may connect the connector C to the cable of such hoist.

The conventional connector C includes a body 42*a* whose vertical parallel walls 43 and 44 are provided with internal support ledges 45 and 46, respectively, which define a throat 47. Vertical flanges 48 and 49 and the internal surface 50 of the body constitute stop means for limiting movement of the top portion 28 of a sinker bar from the connector after the top portion 28 has been moved inwardly into position in the connector body after the groove 35 has been aligned with the throat 47 of the connector body. The height of the groove obviously is greater than the combined heights of the ledges 45 and 46 and their flanges or stops 48 and 49.

After the connector body has been moved over the top portion 28 of the sinker bar with the flanges 48 and 49 moving through the groove 35, the connector is raised so that the top shoulder 36 rests on the ledges 45 and 46. A latch ring 50 may then be lowered until it engages the latch ring stops 52 and closes the throat 47 to prevent accidental dislodgment of the top portion of the sinker bar from the connector.

In use, when a string of sinker bars is being made up, a partially assembled string of sinker bars 10, which extend downwardly into the tubing, is held against vertical movement by a first elevator connector E connected to the top portion of the topmost sinker bar of such particularly assembled sinker bar string positioned above the work platform, the first elevator connector engages the work platform and thus is held against downward movement. A coupling 25 is of course threaded on the top pin of such topmost sinker bar.

A hoist connector connected to the bottom end of the hoist cable is then connected, as described, to the top portion of a sinker bar resting in the rack and the hoist is operated to move the sinker bar from the rack into vertical alignment with the partially assembled sinker bar string, and then lowered and its bottom pin threaded into the coupling or box already connected to the top pin of the top sinker bar of the partially assembled sinker bar string.

A second elevator connector secured to the elevator cable by a hook H is then engaged with the just connected sinker bar and the first elevator connector is then disengaged from the sinker bar whose top end is just above the work platform. The elevator and second elevator connector are now employed to lower the string of sinker bars into the well tubing until the top portion of the just connected sinker bar is above the work platform and the second elevator connector engages the work platform to hold the partially assembled sinker bar string against downward movement.

This sequence of operations is then repeated as required to move sequentially the sinker bars off the rack and connect them to form the complete string of sinker bars.

It will be apparent to those skilled in the art that two elevator connectors are used with the hook H being used to engage alternately the bails 55 of the two elevator connectors and move them upwardly from the work platform, hold them as they are connected to each sinker bar and moved downwardly as the sucker rod is made up and lowered into the well tubing.

After the full string of sinker bars is made up, the lowermost of the sucker rods is similarly connected to the topmost sinker bar and then the remainder of the sucker rods are similarly sequentially connected to form the sucker rod string.

When the sinker bars of a string must be disassembled the above sequence of operations is reversed. A first elevator connector E is employed to move the string upwardly, a second elevator connector is used to hold the string against downward movement while the first elevator connector is released from the topmost sinker bar, the hoist connector is connected thereto and the topmost sinker bar is disconnected from the next uppermost sinker bar and moved by the hoist to the rack.

It will be apparent that while the above description for purposes of clarity refers to connection and disconnection of single sinker bars, it will be apparent that stands or multiples of two or more sinker bars already connected to one another, may similarly be connected to form the sinker bar string and such stands or multiples be similarly disconnected.

It will now be apparent that the sinker bars embodying the invention provide substantial savings in time and effort in their assembly and disassembly since the usual elevator and hoist connectors may be efficiently and easily connected to and disconnected from the sinker bars.

Figure 6:
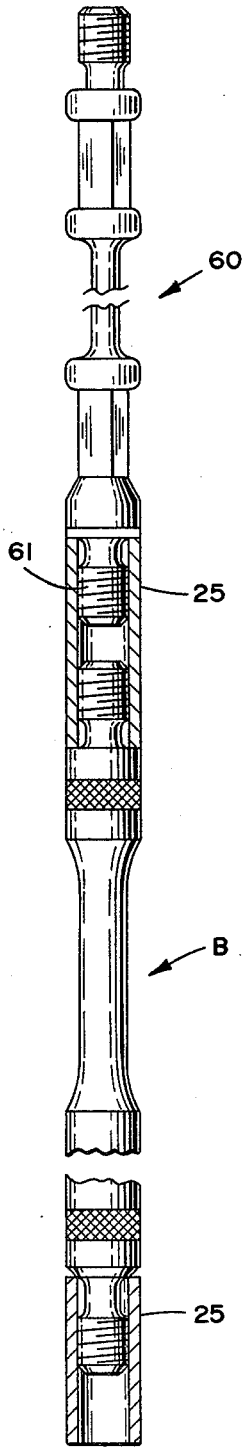
FIG. 6 is a partially sectional view illustrating a conventional sinker bar and a pony bar used to move the sinker bar to and from alignment with the well bore.

Referring now to FIG. 6, the now used method of connecting conventional sinker bars not provided with the grooves 36 in their top portions requires the use of an auxiliary tool such as a pony sucker rod 60 during assembly and disassembly operation. Such pony sucker rods have the same configuration as the usual sucker rods but are of substantially shorter lengths.

It will be apparent that the pony sucker rod must be connected to the topmost sinker bar by a coupling 25, the hoist connector connected to the pony sucker rod and after the sinker bar has been moved to the rack, the pony bar must be disconnected from the coupling for use on the next sinker bar. Alternately, a pony sucker rod must be provided for each sinker bar and such pony sucker rod must then be disconnected after each sinker bar is moved from the rack and connected to the sinker bar string.

A preferred form of the sucker rod embodying the invention has a body 16 twenty-five feet in length with the top portion 28 being two feet in length, the reduced portion 29 and its shoulders 31 and 32 having a combined length of six feet and the bottom portion being seventeen feet in length. The diameter of the top and bottom portions will vary, of course, with the diameter of the tubing in which the sinker bars are to be used. For example, for use in tubing having an internal diameter of 1.751 inches, the maximum diameter of the sinker bar may be 1.375 inches while for use in tubing having an internal diameter of 2.992 inches, the maximum diameter of the sinker bars is to be 2.0 inches.

The diameters of the top and bottom portions 28 and 30 of the sinker bars and of the couplings or boxes 25 connecting the sinker bars to one another may be smaller than the diameters of the couplings connecting sucker rods to one another since the weight supported by the sinker bars and their couplings is less than the weight supported by the sucker rods. Such decrease in diameter facilitates fluid flow in the tubing past the sinker bars even though, of course, the diameters of the top and bottom portions of each sinker bar must be greater than that of the shanks of the sucker rods.

It will now be apparent that a new and imroved sinker bar has been illustrated and described which is economical to fabricate and which facilitates connection and disconnection of the sinker bars to and from one another and to and from the pump operator and the sucker rod string.

It will also be seen that the provisions of the annular groove 35 permits connection of the sinker bars directly to a hoist connector without the use of a pony sucker rod.

What we claim as new and desire to secure by Letters Patent of the United States is:

1. A sinker bar connectible to a hoist connector comprising: an elongate body; a reduced threaded top pin; and a reduced threaded bottom pin, said pins extending longitudinally in opposite directions from opposite ends of said body, said body having a top portion, a bottom portion and a reduced portion between said top and bottom portions, said top portion having an external annual groove providing means for connecting said body to a hoist connector, said top portion being of substantially shorter length than said bottom portion, said means comprising an annular downwardly facing stop surface defining the top of said groove engageable by an upwardly facing surface of a hoist connector, said sinker bar being circular in cross section throughout its length.

* * * * *